US006866569B2

(12) United States Patent
Cozzini

(10) Patent No.: US 6,866,569 B2
(45) Date of Patent: Mar. 15, 2005

(54) BLADE SHARPENING APPARATUS

(75) Inventor: Ivo Cozzini, Lincolnwood, IL (US)

(73) Assignee: Cozzini, Inc., Chicago, IL (US)

( * ) Notice: Subject to any disclaimer, the term of this patent is extended or adjusted under 35 U.S.C. 154(b) by 0 days.

(21) Appl. No.: 10/294,783

(22) Filed: Nov. 14, 2002

(65) Prior Publication Data

US 2004/0097179 A1 May 20, 2004

(51) Int. Cl.[7] ..... B24B 3/36
(52) U.S. Cl. ..... 451/349; 451/319
(58) Field of Search ..... 451/349, 540, 451/486, 555, 319, 556, 558, 522; 76/82, 86, 88

(56) References Cited

U.S. PATENT DOCUMENTS

| | | | | |
|---|---|---|---|---|
| 578,440 A | | 3/1897 | Beaudin | |
| 1,041,631 A | | 10/1912 | Johnson | |
| 1,570,083 A | | 1/1926 | Runzi | |
| 1,851,520 A | | 3/1932 | Moller | |
| 1,909,743 A | | 5/1933 | Blankner | |
| 2,124,646 A | | 7/1938 | Barsch | |
| 2,544,193 A | | 3/1951 | Trapani et al. | |
| 2,767,530 A | | 10/1956 | Paklanius | |
| 2,885,836 A | | 5/1959 | Robitaille | |
| 4,530,188 A | | 7/1985 | Graves | |
| 4,550,632 A | | 11/1985 | Inman | |
| 4,624,079 A | | 11/1986 | Bonapace | |
| 4,897,965 A | * | 2/1990 | Friel | 451/282 |
| 4,934,110 A | | 6/1990 | Juranitch | |
| 5,040,435 A | | 8/1991 | Millman | |
| 5,046,385 A | | 9/1991 | Cozzini | |
| 5,163,251 A | | 11/1992 | Lee | |
| 5,245,789 A | * | 9/1993 | Rees et al. | 451/198 |
| 5,440,953 A | * | 8/1995 | Gangelhoff et al. | 76/86 |
| 5,478,272 A | * | 12/1995 | Cozzini et al. | 451/540 |
| 6,312,017 B1 | * | 11/2001 | Hardwick et al. | 280/825 |
| 6,679,767 B2 | * | 1/2004 | Lohnert | 451/319 |
| 2004/0014415 A1 | * | 1/2004 | Stallegger et al. | 451/555 |

FOREIGN PATENT DOCUMENTS

| | | |
|---|---|---|
| DE | 190414 | 6/1957 |
| GB | 293785 | 3/1928 |
| GB | 517242 | 8/1939 |

* cited by examiner

*Primary Examiner*—Lee D. Wilson
(74) *Attorney, Agent, or Firm*—Barnes & Thornburg LLP

(57) ABSTRACT

An apparatus for sharpening a blade having a base member with a slot for receiving and guiding a blade to be sharpened, first and second apertures disposed on either side of the slot, first and second resilient biasing members disposed in association with each of the first and second apertures such that each of the biasing members is substantially entirely enclosed within rear spring caps and protected from debris and contaminants. Sharpening members are connected to the biasing members and are rotatable about a central axis of each respective aperture between a first and second position, which rotation is limited by a stop member as the blade passes from one end of the slot toward the other. The durability of the base is enhanced with top guide rails so a blade entering the slot cannot cut into the base member.

25 Claims, 5 Drawing Sheets

BLADE SHARPENING APPARATUS

BACKGROUND OF THE INVENTION

1. Field of the Invention

The present invention relates to an apparatus for unrolling and sharpening a cutting edge on a blade that has its edges rolled or dulled. More specifically, the invention is directed toward improvements including top guide rails and the rear spring caps in such an apparatus. The invention includes improvements to the structure of the slot at the opening, including angled guide rails, and also, the resilient springs are more versatile and can be used in both flanges, each rear spring cap is only properly insertable in one side of the base due to their shape, and the pin rods and their relation to the base have been improved.

From time to time it becomes necessary to straighten, realign and sharpen the microscopic edge of a cutting tool such as a knife. During use, the edge of a blade becomes rolled or turned from direct contact with hard objects. It is important to maintain a uniform pressure and a proper even edge angle when sharpening a cutting edge. Previous sharpening devices have involved complex implements that commonly remove material from the cutting edge. Additionally, many of the previous devices are designed for use either only by a right-handed or left-handed person while sharpening one side of the edge at a time, not both. The present invention relates to a sharpener having a substantially enclosed versatile biasing assembly that resists contamination during use and provides for outstanding cleaning.

2. Description of the Prior Art

U.S. Pat. No. 5,478,272 owned by applicant herein describes apparatus for sharpening a cutting edge on a blade. The invention disclosed herein addresses specific improvements to that U.S. Pat. No. 5,478,272 owned by applicant herein describes apparatus for sharpening a cutting edge on a blade. The invention disclosed herein addresses specific improvements to that apparatus. Although that apparatus successfully sharpens blades, the top portion could become worn through careless contact by the blade to be sharpened. Also, in replacing worn parts, the sharpening members could be installed backwards, and the stop members were difficult to remove because they did not pass through the entire base.

Earlier devices for sharpening blades fall into three broad categories: (a) devices having sharpening elements in permanent fixed relationship such as that disclosed in U.S. Pat. Nos. 578,440; 1,851,520; 1,909,743; 2,767,530 and 5,163,251; (b) devices having sharpening elements in movable relationship to each other with fully exposed biasing assemblies such as that disclosed in U.S. Pat. No. 4,934,110; and (c) devices having sharpening elements in movable relationship to each other with biasing assemblies not shielded from debris such as that disclosed in U.S. Pat. Nos. 1,041,631; 1,570,083; 2,124,646; 2,885,836; 4,550,632; and 4,624,079 as well as Patent Nos. GB 293,785 and GB 517,242.

There are problems and limitations with all of these earlier devices. Devices having sharpening elements in fixed relationship to each other are relatively inefficient, needing considerably more resistance when passing a blade between the elements in order to sharpen the blade and may not provide optimal sharpening of the blade. These arrangements often remove perceptible metal fragments from the blade, which shortens the useful blade life and is undesirable for contamination reasons.

In movable element arrangements, exposed biasing means, such as counterweights, lever arms, springs and the like, are prone to collect food particles and other debris during use. These sharpening devices are often used in food processing plants where the blades to be sharpened are full of meat particles. Where the spring is not shielded from debris that may accumulate during use, this condition can cause related problems of contamination and disease.

In certain food industries, governmental authorities regulate and inspect the processing of food for sale to consumers. While many sharpening devices produce a sharp blade, these prior devices have disadvantages of exposed parts or configurations that collect debris and contribute to the problems of contamination and disease. Additionally, cleaning the exposed parts of known devices is costly as these require specific attention to the meshed windings of springs and counterweights and the like. Cleaning may require disassembly of the housing in order to clean the apparatus and remove the debris. Sometimes when an operator is using prior art devices, the operator may be of the misconception, in not seeing the debris that is collecting, that all is well and the apparatus does not need cleaning, which in fact is not the case. Thus, there is a need for a blade sharpening apparatus of the present invention that eliminates operator error due to unseen contamination, reduces cleaning and maintenance costs, and eliminates contamination thereof.

Accordingly, it would be desirable to provide an improved blade sharpener. It has therefore been found beneficial to produce a blade sharpener with top guide rails at the upper end of the slot opening, springs that are more versatile and can be used in both flanges, improved rear spring caps that are only properly insertable due to their shape, and improved stop members that completely pass through the base.

SUMMARY OF THE INVENTION

The present blade sharpening apparatus includes a base member having a front face and a rear face. The base member has a slot adapted to receive and guide a blade to be sharpened. It is a primary objective of the present invention to enhance the durability of the base and the slot opening with top guide rails so a blade approaching the slot cannot cut into the plastic or other material of the base member.

The base member also has first and second apertures, one disposed on either side of the slot. Associated within the apertures are disposed a pair of resilient biasing members, such as springs, with each of the biasing members being substantially entirely enclosed within the base member. A first sharpening member is connected through a rotatable post to one of the resilient biasing members and is rotatable about a central axis of the first aperture with a first stop member adapted to limit the rotational movement of the first sharpening member in one direction. A second sharpening member is connected through a rotatable post to the second resilient biasing member and is rotatable about a central axis of the second aperture having a second stop member adapted to limit the rotational movement of the second sharpening member in one direction. The resilient biasing members are oriented so as to urge the respective sharpening members to a first position in which each of the sharpening members lies across a plane passing through the slot. In a preferred embodiment, the present invention may include two oppositely shaped rear spring caps that can only be installed in one position each for proper alignment of the rotatable posts and the sharpening members. The caps are marked with an indicium that corresponds to an indicium on the base, and if the spring caps are put into the wrong side, it is impossible to assemble the blade sharpener because the flanges will not fit into the base.

The sharpening members when in the first position define a V-shaped intersection overlying the slot. The first and second resilient biasing members are further operative to allow rotation of the respective sharpening members from the first position to a second position as the blade passes from one end of the slot toward the other. The resilient biasing members are enclosed within the base member and protected from debris and contaminants. The biasing members preferably use the same type of resilient biasing member (spring) on each side. The present invention provides improved features, make parts easier to remove and assemble, including stop members with a shoulder, which pass completely through an aperture in the base.

BRIEF DESCRIPTION OF THE DRAWINGS

The above mentioned and other features of this invention and the manner of obtaining them will become more apparent, and the invention itself will be best understood by reference to the following description of embodiments of the invention taken in conjunction with the accompanying drawings in which.

DETAILED DESCRIPTION OF THE INVENTION

Figure 1:
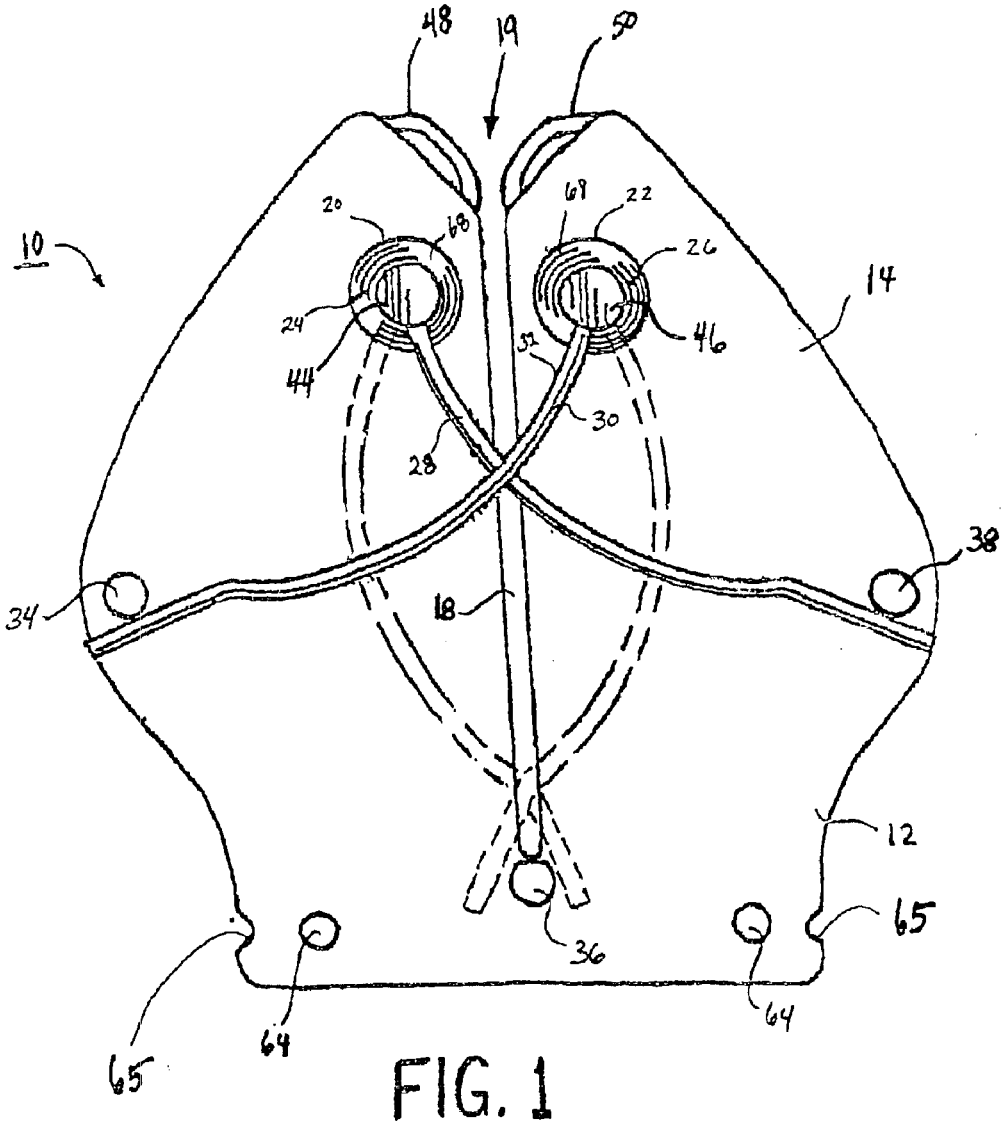
FIG. 1 is a front view of the preferred embodiment of the blade sharpening apparatus of the present invention.

In the Figures, like reference numerals indicate the same elements throughout. Referring to FIG. 1, a front view illustration of a preferred blade sharpening apparatus of the present invention generally designated as 10 is shown. The blade sharpener 10 generally includes a base member 12 having a front face 14. A slot 18 is formed in the base member for receiving and guiding a blade during sharpening. An entrance 19 allows the blade to be inserted through the slot 18. The base member 12 also includes a pair of apertures 20 and 22 for receiving and substantially entirely enclosing a pair of biasing members 24 and 26 so as to protect them from debris and other particles during use. The pair of apertures go all the way though the base member 12. The blade sharpener 10 of FIG. 1 includes first, second and third sharpening members 28, 30 and 32 (the third sharpening member 32 is positioned behind the second sharpening member 30, which is more clearly illustrated in FIG. 4), preferably curved rods, which are used to sharpen the cutting edge of a knife blade or other cutting tools such as a scissors, shears or hedge trimmers. The sharpening members 28, 30 and 32, as rods, will unroll the tiny microscopic teeth on the edge of the blade when the blade is drawn across the straight ends of the rods using light pressure. After straightening the edge of the blade, the blade is drawn through the curved rods with light pressure to sharpen the blade.

The base member 12 is provided with stop members 34, 36 and 38, preferably pins with knobs on the distal ends, which are configured to control and limit the rotation of the sharpening members 34, 36 and 38 between a first "at rest" position, as illustrated by the solid lines in FIG. 1, and a second position as illustrated by the dotted lines in FIG. 1. Stop members 34, 36 and 38 preferably pass completely through the base member 12 for easier removal and reassembly. The stop members 34, 36 and 38 may have a shoulder so they are flush with the front face 14 of the base member 12.

The base member 12 is generally formed of a hard durable plastic, such as polypropylene, that is easily cleaned by water and/or a cleansing solution. The base member 12 can be formed of any desired shape.

Figure 6:
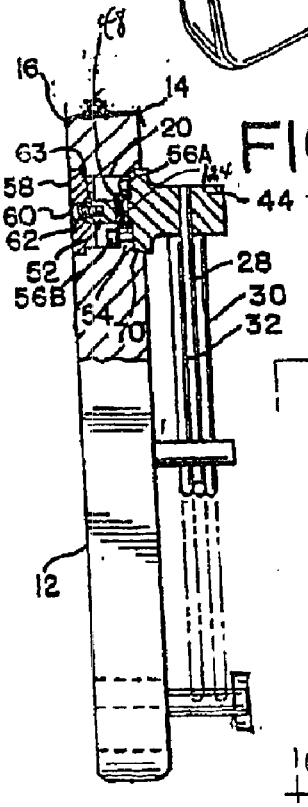
FIG. 6 is a side view, taken along lines 6—6 of FIG. 5.

Rotatable posts 44 and 46 extend outwardly from the front face 14 of the base member and are rotatable about a central axis of the apertures 20 and 22 respectively. Sharpening rods 30 and 32 are secured to post 46 for rotation therewith and sharpening rod 28 is secured to post 44. As best shown in FIG. 6, the post 44 includes a stem 52 extending from one end. The same stem is present on post 46, which is identical in structure to post 44.

Figure 7:
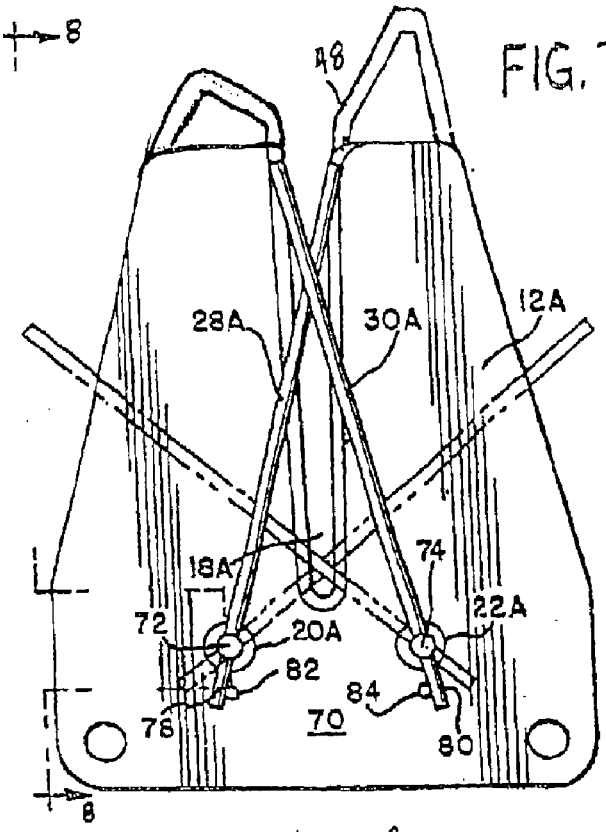
FIG. 7 is a front view illustrating a blade sharpening apparatus of another embodiment of the present invention.

The blade sharpener 10 includes top guide rails 48 and 50 so as to allow a blade to be easily inserted at the upper portion of the slot 18. The guide rails 48 and 50 are preferably formed of metal and angled toward the entrance 19 of the slot 18 to guide a blade into the slot 18 without the blade contacting the base member 12. Alternately, the guide rails 48 and 50 can be offset with one higher than the other as shown in FIG. 7 to help guide the blade into the slot 18. Preferably, the gap between guide rails 48 is slightly narrower than the slot 18.

Figure 8:
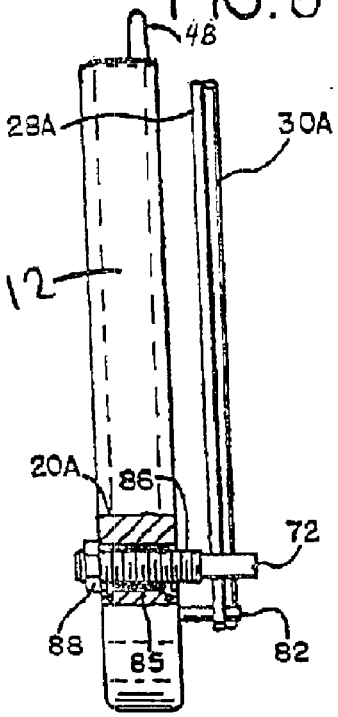
FIG. 8 is a side view, taken along lines 8—8 of FIG. 7.
Figure 9:
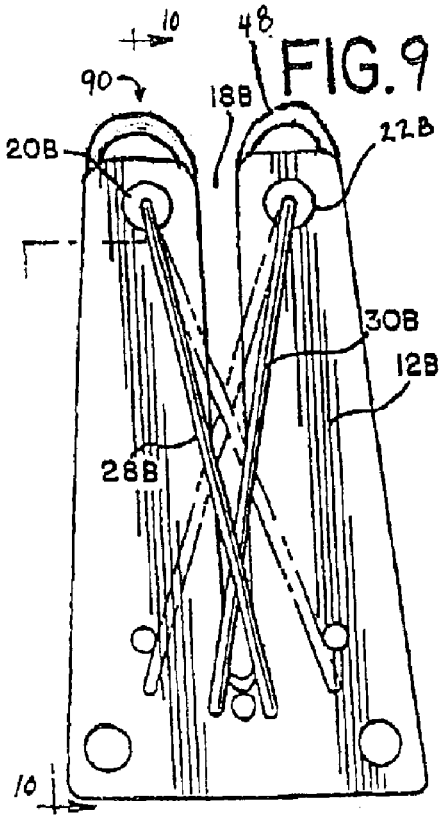
FIG. 9 is a front view illustrating a blade sharpening apparatus of another embodiment of the present invention.

The sharpening members 28, 30 and 32 are manufactured from suitable material to sharpen a blade, such as, 440 C stainless steel hardened to 59–60 Rockwell C Standard by heat treating or the like. The sharpening members 28, 30 and 32 are illustrated as curved in shape but can also be straight as shown in the embodiments of FIGS. 7–9. The embodiments of FIGS. 1–6 illustrate three sharpening rods, which is preferable, but either of rods 30 or 32 could be eliminated resulting in an apparatus having only two sharpening rods, one extending across the slot 18 from each side thereof. Also, embodiments can be constructed having more than three sharpening rods if desired. The rods 30 and 32 are mounted parallel to each other but are spaced apart to define a gap therebetween through which the sharpening rod 28 extends.

The stop members 34, 36 and 38 can be manufactured from steel, plastic, or other suitable material as is known in the art to be durable and to withstand the rigors of use. The stop members 34, 36 and 38 may be pins that have a shoulder that will be flush when the pins are pressed into the base. Since the stop members go all the way though the base member 12, the stop members 34,36 and 38 can be more easily removed and reassembled if the stop members 34, 36 and 38 become worn out.

The biasing members 24 and 26 can be made from rotary coil torsion springs having two free ends. In a preferred embodiment, each torsion spring provides approximately 0.51–0.55 pound-inches of torque to the rotatable posts 44, 46 and the sharpening members 28, 30 and 32 respectively connected thereto. The torsion spring should preferably be selected to provide such biasing torque although other tensions and torque specifications are contemplated depending on the desired application. Other resilient biasing mechanisms capable of accomplishing the same result could be substituted for the torsion spring mechanism.

The base member 12 further includes mounting holes 64 so that the blade sharpening apparatus 10 can be secured to a work station, countertop, machine, assembly line or the like. Bolts can be inserted through mounting holes 64 and mounting surface, and then fastened with nuts and washers as appropriate. Alternately, the blade sharpener 10 can be mounted on the top of a work table or cutting board using grooves 65 in the bottom lip of base member 12.

The posts 44 and 46 can be formed from DELRIN plastic or other suitable material as will be apparent to one skilled in the art. The posts 44 and 46 both include a front cover portion 68 in the form of a skirt that overlies and seals the apertures 20 and 22 on the front face 14 of the base member 12. The front cover portion 68 is rotatably received in a recess 70 (FIG. 6) formed within the apertures 20 and 22.

Figure 2:
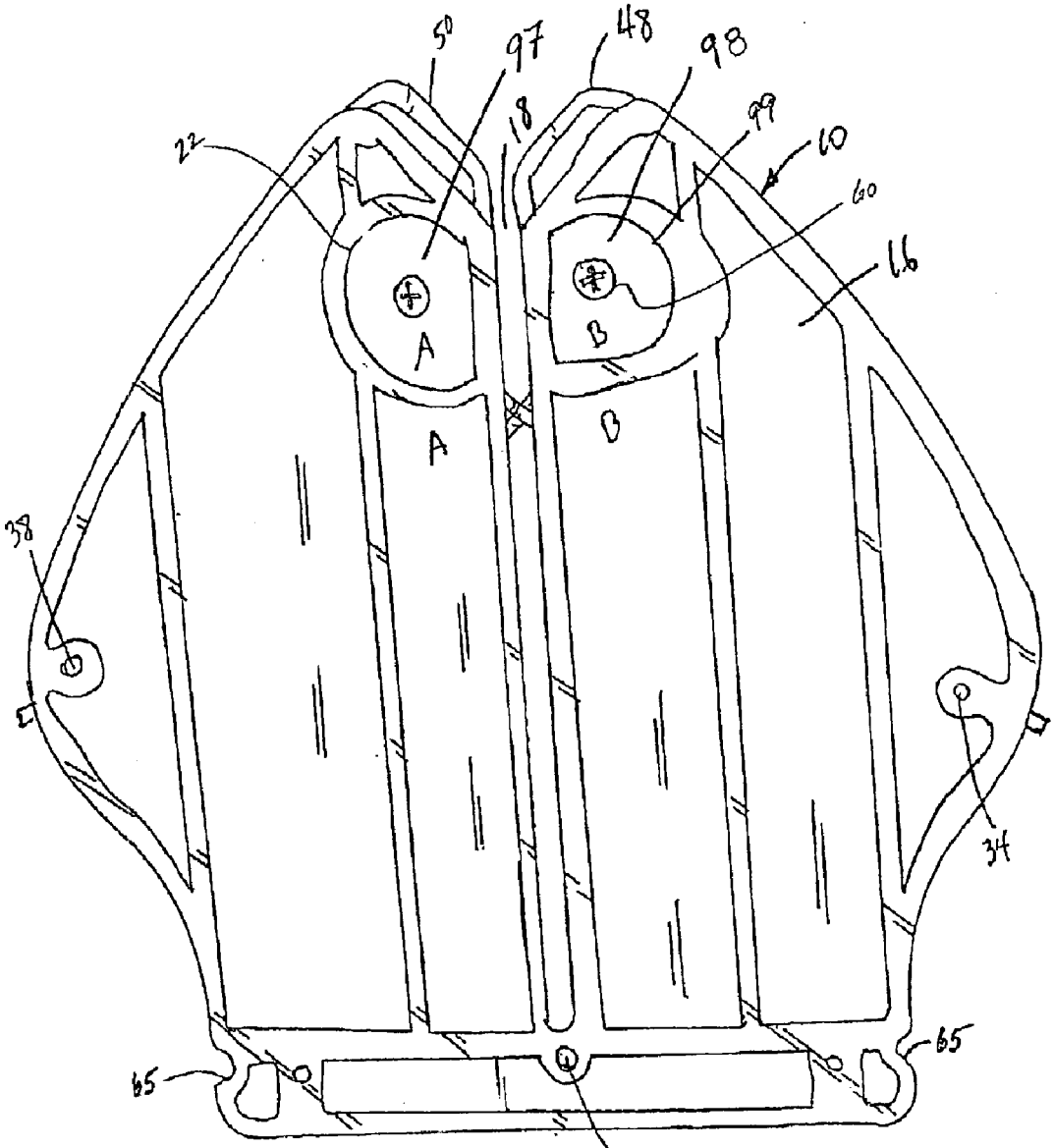
FIG. 2 is a rear view of the embodiment of FIG. 1 illustrating oppositely shaped rear spring caps.

FIG. 2 shows a rear face 16 of the preferred embodiment of FIG. 1 with oppositely shaped rear spring caps 97 and 98 on each side of the slot 18. In this preferred embodiment, that can be used in conjunction with any of the later described embodiments, the present invention includes two oppositely shaped rear spring caps 97 and 98 that fit into complementary shapes 99 on the rear face 16. The caps 97 and 98 can be D-shaped or any other shape so caps 97 and 98 can only be installed in one position each for proper alignment of the rotatable posts 44 and 46 (or 72 and 74 described later with regard to FIGS. 7 and 8) and the sharpening members. The caps 97 and 98 can be marked with an indicium that corresponds to an indicium on the rear face 16, such as "A" and "B" as shown in FIG. 2. The indicium on at least one rear spring cap corresponds to the indicium on an adjacent portion of the rear face. If the spring caps 97 and 98 are put into the wrong side, it is impossible to assemble the blade sharpener 10 because the flanges will not fit into the base.

The caps 97 and 98 seal the apertures (i.e., 20 and 22) on the rear face 16 of the base member 12 similar to the rear cover portions 58 discussed below and illustrated in FIG. 6. The caps 97 and 98 include central bore 62 and a recess 63, which receives a stem 52. The term "rear cover portions" is meant to define caps 97 and 98. A screw 60 passes through the central bore 62 and is secured into the end of stem 52, thereby sealing the apertures 20 and 22 on the rear face 16 thereof and securing the rotatable posts 44, 46, 72 or 74 in place. In this manner, the posts are secured to the base member 12 and are able to rotate with their associated sharpening members.

Figure 3:
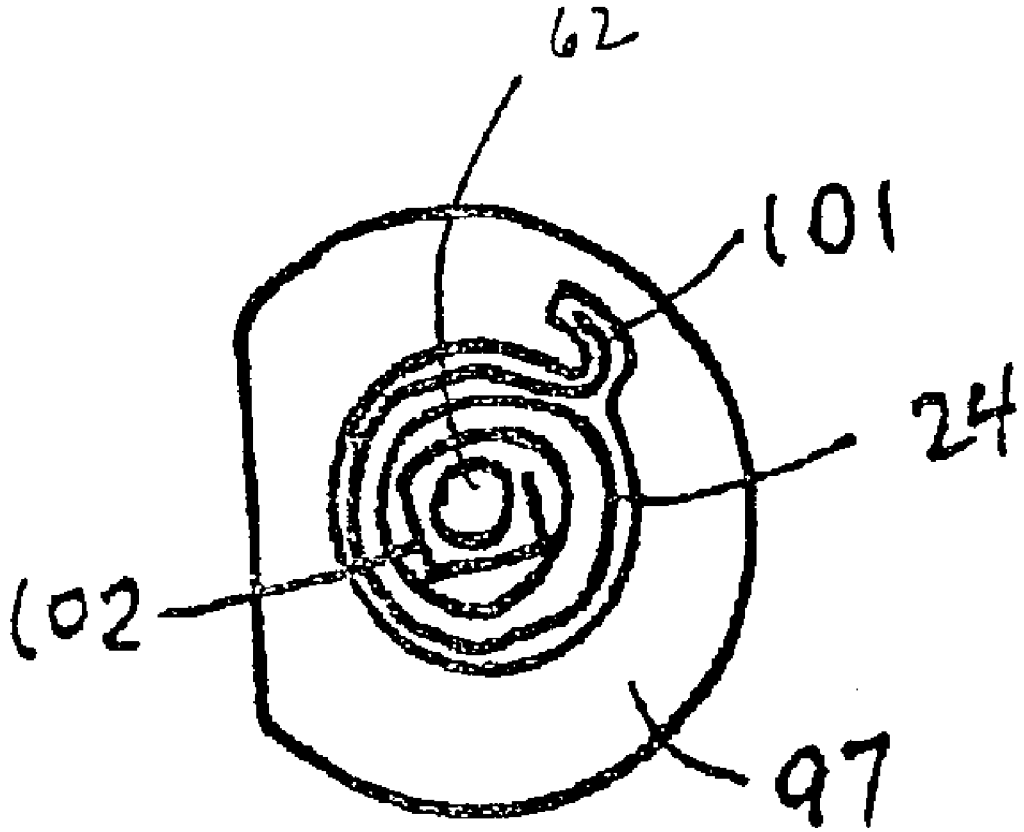
FIG. 3 shows a rear spring cap as illustrated in FIG. 2 accommodating a biasing member

As shown in FIG. 3, a cap 97 accommodates a biasing member 24 shielding it from contaminants during use. The side shown in FIG. 3 would face inward toward the rear face 16. The biasing member 24 is preferably completely inserted into a recess in the cap 97 and, as a torsion spring as shown, is attached at one end 101 to the cap 97 and coiling in a counterclockwise direction. For this specific configuration, the stem 52 would have at least two flattened sides to coordinate with the second end 102 of the biasing member 24, which is shown as three sides of a square. The "B" cap 98 would be of a similar construction, but opposite with the coil rotating in the clockwise direction.

In operation, a blade with rolled edges is positioned at the top of slot 18 and passed downwardly to the bottom of the slot 18 through the sharpening members 28, 30 and 32. The blade is pulled straight down until the sharpening members 28, 30 and 32 contact stop member 36. Then with light pressure, the blade is drawn across the sharpening members 28, 30 and 32 until the tip of the blade clears the sharpening members 28, 30 and 32 and the sharpening members 28, 30 and 32 spring back to the stop members 34 and 38 respectively. This motion unrolls curled edges of the blade.

Figure 5:
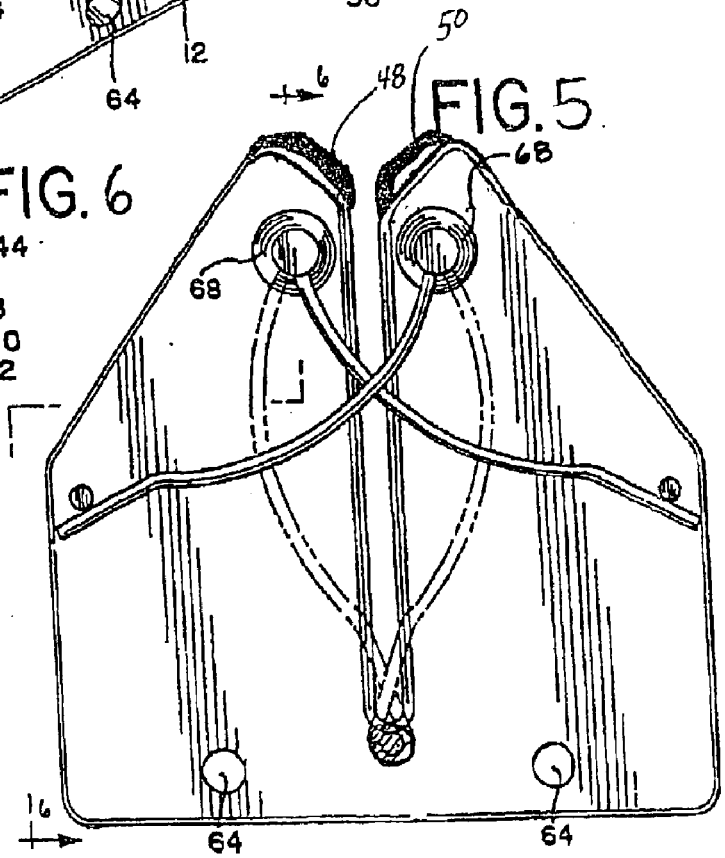
FIG. 5 is a front view illustrating the blade sharpening apparatus of FIG. 4.

After the straightening procedure, the blade may also be sharpened. At the top of the slot 18, the handle or hilt end of the blade is positioned close to the front face 14, while the pointed end of the blade extends well beyond the rear face 16, depending on the length of the blade. The blade is ideally pulled about three-quarters of the way down the slot 18 through the sharpening members 28, 30 and 32 in one continuous motion. As the blade is drawn from the top of the slot 18 to the bottom, it is also drawn horizontally through the slot 18 so the entire length of the blade is sharpened from the hilt to the point. The sharpening members 28, 30 and 32 contact and sharpen the cutting edge of the blade. As the blade moves downwardly the sharpening members rotate and move downwardly with the blade against the torque of biasing members 24 and 26. The sharpening members 28, 30 and 32 rotate from the first position as shown in full lines in FIGS. 1 and 5 to the second position shown in dotted lines when the blade passes from top to bottom. The sharpening members 30 and 32 extend downwardly and across slot 18 from right to left, as shown in FIGS. 1 and 5, while blade 28 extends downwardly and across slot 18 from left to right. The blades intersect in a V-shape to lie across the slot. When sharpening the unrolled blade, the blade should ideally not be pushed all the way down so that the sharpening members 28, 30 and 32 come in contact with stop member 36.

Figure 4:
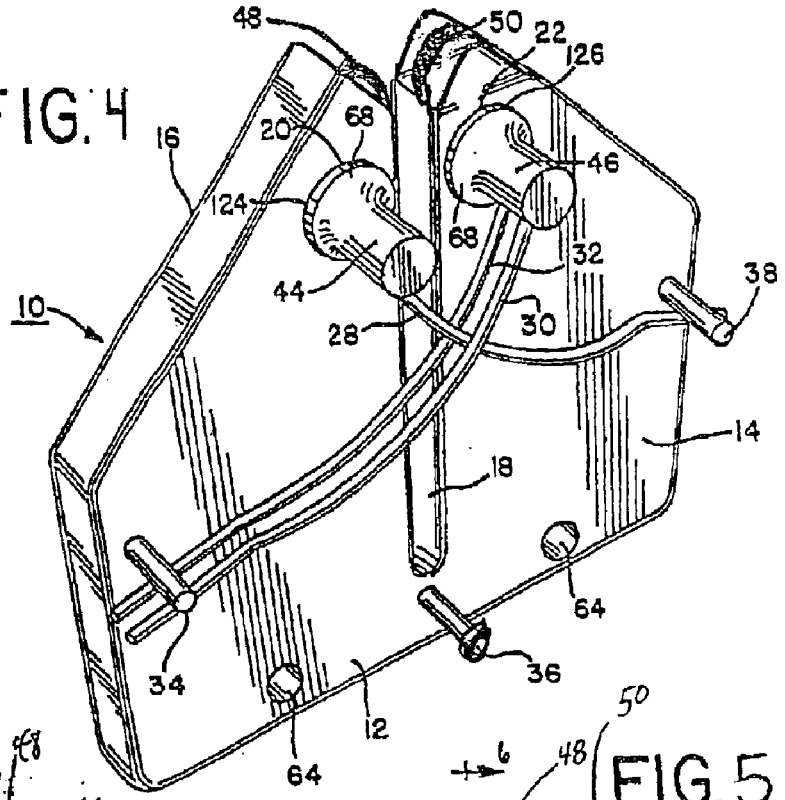
FIG. 4 is a perspective view illustrating a second embodiment of the blade sharpening apparatus.

Referring to FIGS. 4–6, another embodiment of a blade sharpening apparatus 10 of the present invention is illustrated. The blade sharpener 10 generally includes a base member 12 having a front face 14, a rear face 16 and a slot 18 formed in the base member for receiving and guiding a blade during sharpening. The base member 12 also includes a pair of apertures 20 and 22 for receiving and substantially entirely enclosing a pair of biasing members 124 and 126 so as to protect them from debris and other particles during use. The pair of apertures go all the way though the base member 12. The blade sharpener 10 of FIGS. 4–6 includes first, second and third sharpening members 28, 30 and 32 as discussed above.

The base member 12 is provided with stop members 34, 36 and 38 to control and limit the rotation of the sharpening members 34, 36 and 38 between a first "at rest" position, as illustrated by the solid lines in FIG. 5, and a second position as illustrated by the dotted lines in FIG. 5. Stop members 34, 36 and 38 preferably pass completely through the base member 12 for easier removal and reassembly. The stop members 34, 36 and 38 may have a shoulder so they are flush with the front face 14 of the base member 12.

Rotatable posts 44 and 46 extend outwardly from the front face 14 of the base member and are rotatable about a central axis of the apertures 20 and 22 respectively. Sharpening rods 30 and 32 are secured to post 46 for rotation therewith and sharpening rod 28 is secured to post 44.

The blade sharpener 10 includes top guide rails 48 and 50 so as to allow a blade to be easily inserted at the upper portion of the slot 18. The guide rails 48 and 50 are preferably angled toward the slot 18 to guide a blade into the slot 18 without the blade contacting the base member 12. Preferably, the gap between guide rails 48 is slightly narrower than the slot 18.

FIG. 6 illustrates how the biasing member 124, or spring, is entirely enclosed within the base member 12, which prevents the accumulation of debris, particles and other contaminants, and which advantageously makes the present invention ideally suitable for industrial use.

As best shown in FIG. 6, the post 44 includes a stem 52 extending from one end. The same stem is present on post 46, which is identical in structure to post 44. Disposed within the aperture 20 is a flange 54 configured so that the spring 124 is positioned concentrically over the stem 52. The spring 124 has a pair of free ends, one of which is fastened to the post 44, and the other of which is connected to the flange 54, by suitable fasteners 56A and 56B respectively.

The blade sharpening apparatus 10 further includes rear cover portions 58 for sealing the apertures 20 and 22 on the rear face of the base member 12. FIG. 6 illustrates one such cover portion, which in this case each have an identical configuration. The cover portions 58 are located on the opposite side of the posts 44 and 46. The rear cover portions 58 include a central bore 62 and a recess 63, which receives the stem 52. A screw 60 passes through the central bore 62 and is secured into the end of stem 52, thereby sealing the apertures 20 and 22 on the rear face thereof and securing the rotatable posts 44, 46 in place as previously discussed The operation of the blade sharpening apparatus embodiment of FIGS. 4–6 is substantially the same as shown and described in FIGS. 1–3 for the preferred embodiment.

FIGS. 7 and 8, illustrate another embodiment of a blade sharpening apparatus 70 incorporating the features of the present invention. The blade sharpener 70 generally includes a base member 12A having a slot 18A with a pair of apertures 20A and 22A located at the lower portion of slot 18A. Sharpening members 28A and 30A are secured in rotatable posts 72 and 74 that extend through apertures 20A and 22A. In this embodiment, the sharpening members 28A and 30A are straight and adapted to be secured in the posts 72 and 74 with segments 78 and 80 extending therefrom. The segments 78 and 80 abut stop members 82 and 84 when the apparatus 70 is in the "at rest" position illustrated in full lines in FIG. 7. Each post 72, 74 includes a threaded portion 86, and a rear nut 88 that secures each post within the respective aperture 20A or 22A. A biasing member 85, illustrated as a coil spring, is concentrically mounted over each post 72, 74. The coil spring 85 is shown in FIG. 8 as having one free end constrained by a wall of the apertures 20 and 22 with the other end connected to the post 72 such that the sharpening members are biased to assume a first position shown in full lines in FIG. 7. The resilient biasing member 85 is substantially entirely enclosed within respective apertures 20A and 22A by the nut 88 on the rear face and the threaded portion 86 on the front face. A skirted cover portion (not shown) may be placed on the front face 14A similar to the front cover portion 68 illustrated in FIG. 4. The major distinction between the embodiment shown in FIGS. 4–7 and the embodiment of FIGS. 7 and 8 has to do with the orientation of the sharpening members. In the embodiment of FIGS. 4–6, the sharpening members are mounted toward the top of the slot and extend downwardly across the slot. In the embodiment of FIGS. 7 and 8, the sharpening members are mounted toward the bottom of the slot and extend upwardly across the slot.

In operation, the biasing members of FIGS. 7 and 8 position the sharpening members 28A and 30A in the full line position as shown in FIG. 7. The blade is inserted into the upper portion of slot 18A and, by a downward and simultaneous horizontal movement, the sharpening members 28A and 30A are rotated by the motion of the blade to the second position, shown in phantom in FIG. 4, as the blade is sharpened. Upon removal of the blade from the slot, the resilient biasing members 85 rotate the posts 72 and 74 to return the sharpening members 28A and 30A to the first position. The guide rails 48 and 50 are offset with one higher than the other to help guide the blade into the slot 18. One of top guide rails extends farther from the base member than the other to assist the insertion of a blade. Also the guide rails 48 and 50 extend well above the base member to provide a potential hanging means for when the apparatus is not in use.

Figure 10:
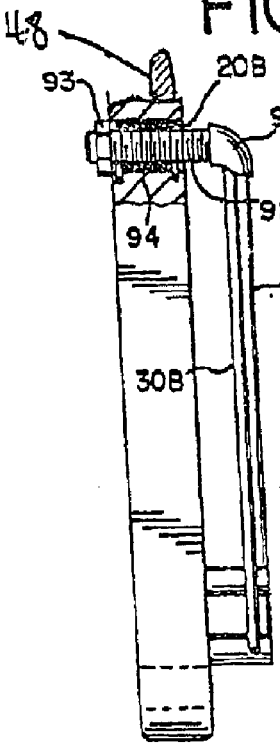
FIG. 10 is a side view, taken along the lines 10—10 of FIG. 9.

Referring to FIGS. 9 and 10, another embodiment of a blade sharpening apparatus 90 incorporating the features of the present invention is illustrated. The blade sharpener 90 includes a base member 12B having a slot 18B disposed at a mid-portion thereof. The apertures 20B and 22B are located adjacent the slot 18B at an upper end thereof. The sharpening members 28B and 30B are formed from straight steel rods. This embodiment shows semicircular top guide rails 48.

A pair of rotatable posts 92 are provided, with a post extending through each aperture 20B, 22B. Each post is threaded at both ends with a nut 93 secured over the post at the rear thereof, as illustrated in FIG. 7. A resilient biasing member in the form of a torsion spring 94 is shown mounted within the aperture 20B overlying and concentric with the post 92. The spring 94 is connected at one end to the post 92 and at the other end to the base member. An elbow 96 connects the post 92 to sharpening member 28B.

The operation of the blade sharpening apparatus of FIGS. 9 and 10 is substantially the same as that shown and described in FIGS. 1–6.

The above description of the invention is intended to be illustrative and not limiting. Although the preferred embodiment of the invention is illustrated and described in connection with a particular type of blade sharpening apparatus, it can be adapted for use with a variety of blade sharpening apparatus. Other embodiments and equivalent tools are envisioned within the scope of the invention. Various features of the invention have been particularly shown and described in connection with the illustrated embodiments of the invention, however, it must be understood that these particular embodiments merely illustrate and that the invention is to be given its fullest interpretation within the terms of the appended claims.

What is claimed is:

1. A blade sharpening apparatus comprising a base member including a front face and a rear face; a slot defined in said base member adapted to receive and guide a blade to be sharpened; first and second apertures defined in said base member, one disposed on either side of said slot; first and second rear spring caps, one disposed on each side of said slot, said first rear spring cap including a first resilient biasing member, said second rear spring cap including a second resilient biasing member; said biasing members are substantially entirely enclosed in said rear spring caps; a first sharpening member indirectly connected to said first resilient biasing member and rotatable about a central axis of said first aperture; a second sharpening member indirectly connected to said second resilient biasing member and rotatable about a central axis of said second aperture; whereby said resilient biasing members are oriented so as to urge said respective sharpening members to a first position in which each of said sharpening members lies across a plane passing through said slot, said sharpening members in said first position defining a V-shaped intersection therebetween, overlying said slot, said first and second resilient biasing members further operative to allow rotation of said respective sharpening members from said first position to a second position as said blade passes from one end of said slot toward the other as said blade is sharpened, and whereby said resilient biasing members are enclosed and protected from debris and contaminants.

2. The blade sharpening apparatus of claim 1 further comprising a top guide rail adjacent an opening of said slot.

3. The blade sharpening apparatus of claim 1 wherein two oppositely shaped rear spring caps fit into complementary shapes on said rear face.

4. The blade sharpening apparatus of claim 1 further comprising an indicium on at least one rear spring cap and indicium on an adjacent portion of said rear face, wherein said indicium on at least one of said rear spring caps corresponds to said indicium on said rear face.

5. The blade sharpening apparatus of claim 1 wherein said biasing members comprise torsion springs completely contained in recesses in said rear spring caps and having one end connected to said rear spring caps and another end connected to supports for said sharpening members.

6. The blade sharpening apparatus of claim 5 wherein said supports are rotatable posts, each including a stem extending concentrically therefrom and disposed within said corresponding apertures, said torsion springs being mounted on said stems.

7. The blade sharpening apparatus of claim 6 wherein each of said rear spring caps include a central bore configured to receive one end of said stem.

8. The blade sharpening apparatus of claim 7 further including a pair of rotatable posts one extending from each of said first and second apertures, wherein each of said posts includes a front cover portion configured to overlie and seal said respective apertures of said base member on said front face thereof, each post being operative to rotate said respective sharpening member.

9. The blade sharpening apparatus of claim 1 further including stop means associated with said front face adapted to limit rotational movement of said sharpening members.

10. The blade sharpening apparatus of claim 9 wherein said stop means has a shoulder abutting said front face and a portion that extends through said base member.

11. The blade sharpening apparatus of claim 1 wherein said first and second apertures are disposed toward an upper end of said slot and said first and second sharpening members extend downwardly across said slot.

12. A blade sharpening apparatus comprising a base member including a front face and a rear face; a slot defined in said base member adapted to receive and guide a blade to be sharpened; first and second apertures defined in said base member, one disposed on either side of said slot;

a top guide rail adjacent an opening of said slot and angled inwardly to said opening of said slot; a pair of rotatable posts, one extending from each of said first and second apertures, each post having an end extending into its corresponding aperture; sharpening members connected to said rotatable posts; a first and second rear spring cap on each side of said slot, said first rear spring cap including a first resilient biasing member, said second rear spring cap including a second resilient biasing member; each of said biasing members is substantially entirely enclosed in a respective spring cap; said posts connected to said resilient biasing members and rotatable about a central axis of said apertures; whereby said resilient biasing members are oriented so as to urge said respective sharpening members to a first position in which each of said sharpening members lies across a plane passing through said slot, said sharpening members in said first position defining a V-shaped intersection there between, overlying said slot, said first and second resilient biasing members further operative to allow rotation of said respective sharpening members from said first position to a second position as said blade passes from one end of said slot toward the other as said blade is sharpened, and whereby said resilient biasing members are enclosed and protected from debris and contaminants.

13. The blade sharpening apparatus of claim 12 wherein said biasing members are torsion springs completely contained in recesses in said rear spring caps and having one end connected to said rear spring caps and another end connected to said posts for said sharpening members.

14. A blade sharpening apparatus, comprising: a base member including a front face and a rear face; a slot defined in said base member adapted to receive and guide a blade to be sharpened, said slot defining an entrance at an upper end thereof; a pair of angularly inclined guide rails extending upwardly from said base member, one disposed on either side of said slot, angled toward said entrance to said slot, said rails protecting said base member and directing the blade into said slot; first and second apertures defined in said base member, one disposed on either side of said slot; first and second resilient biasing members, one disposed within each of said first and second apertures, a first sharpening member connected to said first resilient biasing member and rotatable about a central axis of said first aperture; a second sharpening member connected to said second resilient biasing member and rotatable about a central axis of said second aperture; whereby said resilient biasing members are oriented so as to urge said respective sharpening members to a first position in which each of said sharpening members lies across said slot, said sharpening members in said first position defining a V-shaped intersection therebetween, overlying said slot, said first and second resilient biasing members further operative to allow rotation of said respective sharpening members from said first position to a second position as said blade passes from one end of said slot toward the other as said blade is sharpened.

15. The blade sharpening apparatus of claim 14 further including a pair of rotatable posts one extending from each of said first and second apertures, each post being connected to one of said resilient biasing members and one of said sharpening members, each post being operative to rotate said respective sharpening member.

16. The blade sharpening apparatus of claim 15 wherein said resilient biasing members comprise a torsion spring having one end connected to said base member and another end connected to said post.

17. The blade sharpening apparatus of claim 15 wherein each of said resilient biasing members comprise a torsion spring completely contained in a recess included in each of a first and second rear cover portions configured to overlie and seal said first and second apertures respectively of said base member on said rear face thereof, and having one end connected to said rear cover portion and another end connected to said sharpening members.

18. The blade sharpening apparatus of claim 17 including fastening means securing each of said rear cover portions to said stem thereby sealing the rear face of each of said apertures.

19. The blade sharpening apparatus of claim 15 wherein each of said posts includes a front cover portion configured to overlie and seal said respective apertures of said base member on said front face thereof.

20. The blade sharpening apparatus of claim 15 including a third sharpening member connected to one of said rotatable posts, positioned parallel to said first sharpening member but laterally spaced therefrom, so as to define a gap between said first and third sharpening members, said second sharpening member positioned to lie within said gap.

21. The blade sharpening apparatus of claim 14 including a flange located in each of said first and second apertures, extending from said base member, said flange having connecting means to allow for attachment of said corresponding resilient biasing means to said base member.

22. The blade sharpening apparatus of claim 14 including stop means associated with said front face adapted to limit the rotational movement of said sharpening members.

23. The blade sharpening apparatus of claim 14 wherein said first and second apertures are disposed toward the upper end of said slot and said first and second sharpening members extend downwardly across said slot.

24. The blade sharpening apparatus of claim 14 wherein said first and second apertures are disposed toward the lower end of said slot and said first and second sharpening members extend upwardly across said slot.

25. A blade sharpening apparatus comprising a base member including a front face and a rear face; a slot defined in said base member adapted to receive and guide a blade to be sharpened; first and second apertures defined in said base member, one disposed on either side of said slot; a top guide rail adjacent an opening of said slot and angled inwardly toward said opening of said slot, said guide rail adapted to guide the blade into said slot and protect said base member from contact with the blade at said opening; a pair of rotatable posts, one extending from each of said first and second apertures, each post having an end extending into its corresponding aperture; sharpening members connected to said rotatable posts; a first resilient biasing member and a second resilient biasing member; each of said posts connected to one of said resilient biasing members and rotatable about a central axis of one of said apertures; whereby said resilient biasing members are oriented so as to urge said respective sharpening members to a first position in which each of said sharpening members lies across a plane passing through said slot, said sharpening members in said first position defining a V-shaped intersection there between, overlying said slot, said first and second resilient biasing members further operative to allow rotation of said respective sharpening members from said first position to a second position as said blade passes from one end of said slot toward the other as said blade is sharpened.

* * * * *